United States Patent [19]

Dorakovski

[11] 4,404,829

[45] Sep. 20, 1983

[54] METHOD AND APPARATUS FOR THE MANUFACTURE OF PULLEYS

[76] Inventor: Vanco Dorakovski, 111 25th St., Massillon, Ohio 44646

[21] Appl. No.: 315,713

[22] Filed: Oct. 28, 1981

Related U.S. Application Data

[63] Continuation of Ser. No. 110,943, Jan. 10, 1980, abandoned.

[51] Int. Cl.[3] ..... B21D 22/14

[52] U.S. Cl. ..... 72/84; 72/105; 29/159 R

[58] Field of Search ..... 72/82, 84, 105, 106; 29/159 R

[56] References Cited

U.S. PATENT DOCUMENTS 3,910,423 10/1975 Killian et al. ..... 72/82

4,134,285 1/1979 Iaconetti et al. ..... 72/84

*Primary Examiner*—Lowell A. Larson

*Attorney, Agent, or Firm*—Oldham, Oldham, Hudak, Weber & Sand Co.

[57] ABSTRACT

A method and apparatus for the manufacture of pulleys is presented, wherein the pulley is manufactured from a blank placed between a head stock and a tail stock assembly. While maintaining constant pressure between these two assemblies, the head stock assembly is spun and the pulley blank is transformed into the pulley through the application of stress upon the sidewalls of the pulley blank. When a multiple groove pulley is desired, this transformation is administered by the combination of at least two external spin rollers and at least one internal spin roller, the latter deforming the pulley blank while positioned within the internal circumference of the pulley blank and mounted on an internal roller shaft, rotatable within the pulley drive shaft. When a single groove pulley is desired, the external spin roller may deform the pulley blank. The method of internal deflection during the spin pulley operation increases the quality and the quantity of the final products produced by such apparatus and according to such methods. An automatic orientation device, an automatic blank loading device, and an automatic pulley unloading device is further provided in accordance with the invention to place the blank in its proper position between the head stock and the tail stock assemblies and to remove the final product from the assemblies. The entire machine and its designated process provide an automatic spin pulley manufacturing system.

26 Claims, 18 Drawing Figures

METHOD AND APPARATUS FOR THE MANUFACTURE OF PULLEYS

CROSS-REFERENCE

This is a continuation of application Ser. No. 110,943, filed on Jan. 10, 1980, now abandoned.

BACKGROUND OF THE INVENTION

This invention relates to the method and apparatus for the manufacture of pulleys by an internal spin pulley manufacturing device and process.

Heretofore, one of the methods for the manufacture of pulleys was the use of a spinning metal blank which is deformed by the application of pressure axially and rotationally to create a pulley. The axial pressure administered by the head stock assembly on one side of the blank and the tail stock assembly on the other side of the blank permitted the entire assembly including the blank to rotate. During this rotation, pressure was applied to the outer circumference of the pulley blank in order to form the desired shape of the pulley. This process is not unlike the process used by craftsman at a lathe whereby the desired article is spun on an axis and its shape is controlled by the application of an outside force to the outer surfaces of the object. Examples of prior art utilizing an external application of force to the pulley blank are found in U.S. Pat. No. 3,910,423; U.S. Pat. No. 3,953,995; U.S. Pat. No. 4,055,977; and German Pat. No. 844,587.

The production of pulleys by this spin method utilizing such apparatus is estimated to achieve a production rate of approximately 400 to 500 pieces per hour. In order to improve the quantity of manufacture, a device is needed which eliminates the need for stopping the head stock assembly in order to place the pulley blank in the manufacturing position between the head stock assembly and the tail stock assembly. An attempt has been made to automate the placement of the pulley blank into the assembly through use of automated equipment, disclosed in U.S. Pat. No. 3,910,423. The use of the automated loading equipment with a spin pulley manufacturing device which must stop during each production cycle fails to achieve a maximum quantity of pulleys produced per hour.

SUMMARY OF THE INVENTION

Consequently, it is an object of the invention to provide a completely automated manufacturing apparatus and method for the production of pulleys from pulley blanks where the head stock assembly and tail stock assembly remain rotating during production.

It is another object of the invention to provide a completely automated manufacturing apparatus and method for the production of pulleys wherein the internal spinner roller occupies a position within the internal circumference of the pulley blank when a multiple groove pulley is desired.

It is another object of the invention to provide a completely automated manufacturing apparatus and method for the production of pulleys wherein the external spinner roller deforms single groove pulleys and assists in deformation of multiple groove pulleys.

It is yet another object of the invention to provide a method and apparatus for the manufacture of pulleys by a spinning method and apparatus, wherein the pulley blank is oriented and loaded by means of automated equipment.

It is a further object of the invention to provide a pulley manufacturing device and method wherein the blank is properly aligned between the head stock assembly and the tail stock assembly prior to application of the external and internal spinner rollers to deform the sidewalls thereon.

These and other objects of the invention, which will become more apparent as the detailed description of the preferred embodiment proceeds, are achieved by a method for the manufacture of multiple groove pulleys comprising: (a) inserting a pulley blank into a blank orientation device; (b) removing the pulley blank from said blank orientation device using a blank loading device; (c) positioning the pulley blank, on said blank loading device, in orientation between a tail stock assembly and a head stock assembly of an internal spin pulley manufacturing device; (d) extending a feeder plunger in a spin roller shaft from said head stock assembly to engage the pulley blank at its axis; (e) securing the pulley blank between said head stock assembly and said tail stock assembly; (f) retracting said feeder plunger to within said spin roller shaft; (g) removing said blank loading device; (h) spinning said head stock assembly about a rotatable hollow drive shaft, said spinning revolving the pulley blank and said tail stock assembly; (i) deflecting the axis of said spin roller shaft from the axis of said hollow drive shaft using an elliptical cylinder device; (j) engaging at least one internal spin roller with the internal circumference of the pulley blank; (k) sliding at least two external spin rollers and engaging said external spin rollers with the exterior circumference of the pulley blank; (l) maintaining said internal spin roller engagement during said spinning of said head stock assembly and said securement of the pulley blank between said head stock assembly and said tail stock assembly until a pulley is produced by deformation from the pulley blank; (m) realigning the axis of said spin roller shaft with the axis of said hollow drive shaft, thereby disengaging said internal spin rollers from the internal circumference of the pulley; (n) sliding said external spin rollers from engagement with the exterior circumference of the pulley; (o) extending said feeder plunger from said spin roller shaft to engage the pulley at its axis; (p) inserting an electromagnetic removal disc on a pulley unloading device between said tail stock assembly and said head stock assembly; (q) retracting said feeder plunger to within said spin roller shaft from the internal axis of the pulley; and (r) removing said pulley by said electromagnetic removal disc.

Additionally, a pulley manufacturing device for the transformation of pulley blanks into pulley products having at least one groove, comprising: (a) a manufacturing frame; (b) a spin pulley manufacturing device having a tail stock assembly, a head stock assembly, an internal spin roller assembly, and an external spin roller assembly; (c) a blank orientation device (d) a blank loading device; and (e) a pulley unloading device.

DESCRIPTION OF THE DRAWINGS

For an understanding of the scope of the invention, reference is had to the following drawings.

DETAILED DESCRIPTION OF THE PREFERRED EMBODIMENTS

Figure 1:
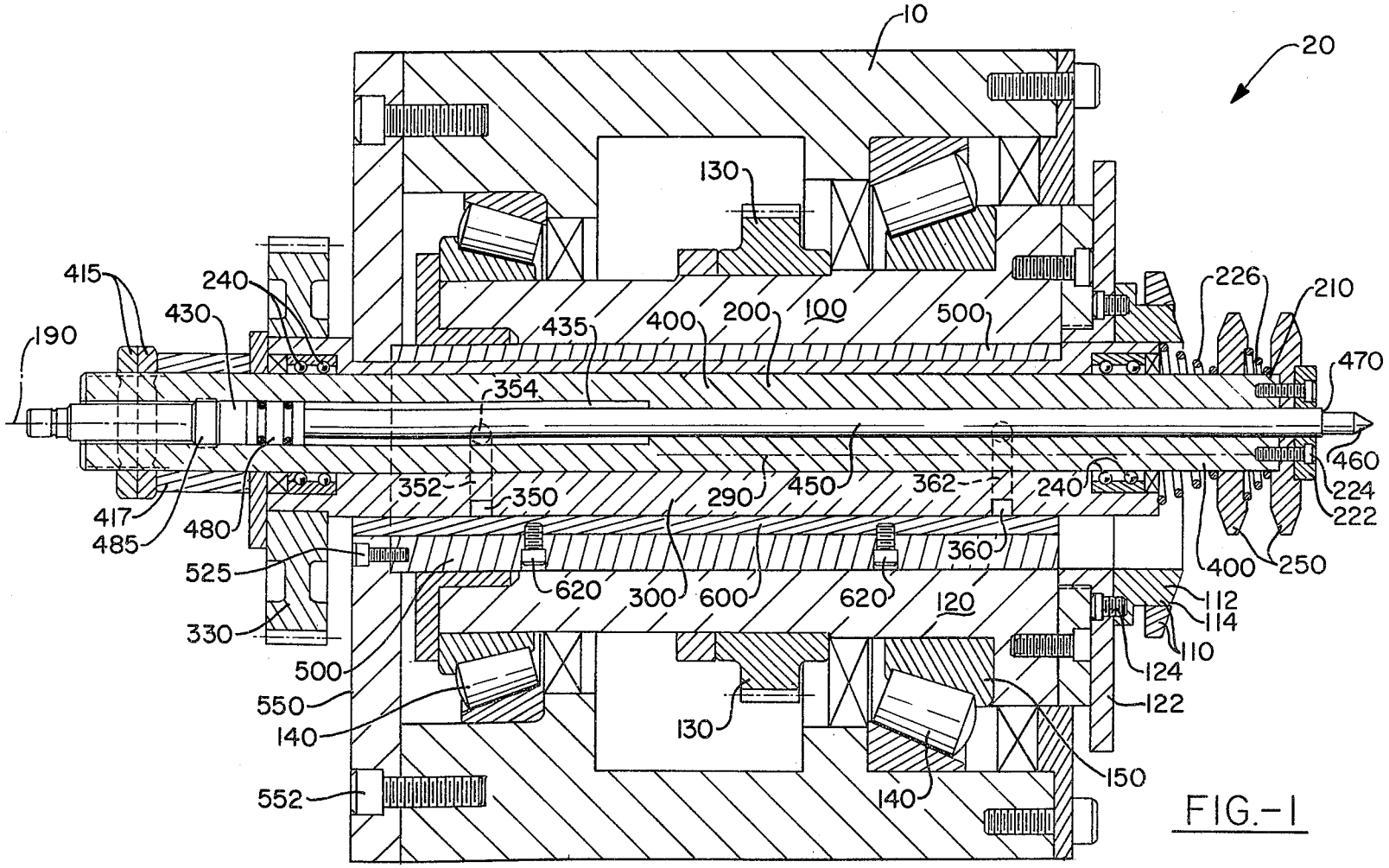
FIG. 1 is a cross sectional view of the head stock assembly having a cross sectional view of the internal spin roller assembly.

Referring to FIG. 1, a cross sectional view of the head stock assembly, generally 100, and a cross sectional view of the internal spin roller assembly, generally 200, an understanding of the scope of the invention may be understood. Head stock assembly comprises the spinning rings 110, drive shaft 120, gearing mechanism 130, and roller bearings 140. Referring now to the spinning ring, the outer surface of the spinning ring 110 engages the open end 52 of the pulley blank 50 as will be explained in greater detail in reference to FIG. 10. The outer surface 112 of the spinning ring is beveled to provide adequate contact with the pulley blank and has a circular notch 114 into which open end 52 of blank 50 resides. The spinning ring 110 is mounted on hollow rotatable drive shaft 120 using plate 122 and fasteners 124 which shaft 120 is rotated by gearing mechanisms 130 from a power source (not shown). The entire head stock assembly 100 is rotated about the roller bearings 140 and bushings 150 which separate the head stock assembly from the frame of the entire machine, generally referred to as 10.

Within the rotatable, hollow drive shaft 120 is the internal spin roller assembly 200. This assembly is composed of several shaft and cylinder means, which in combination, permit the deflection of the axis 290 of the spin roller assembly 200 from the axis 190 of the head stock assembly 100 during manipulation of the pulley blank 50. The internal spin roller assembly 200 is composed of the internal spin roller shaft 400, the oscillating shaft cylinder means 300, the elliptical cylinder 500, and the crescent member 600. The spin roller shaft 400 does not rotate as the drive shaft 120 rotates. Hollow drive shaft 120 rotation and internal spin roller shaft 400 movement are separated by elliptical cylinder 500 and crescent member 600. This separation of rotation is accomplished by fastening and securing the elliptical cylinder 500 on the frame of the machine by means of a plate 550 and fasteners 552 and 525. This separation of rotation permits the mounting of at least one internal spin roller 250 on the end 210 thereof using plate 222, fasteners 224 and helical spring 226. The deflection of the entire spin roller assembly 200, in conjunction with the spinning of the head stock assembly 100 manipulates the pulley blank 50.

Figure 4A:
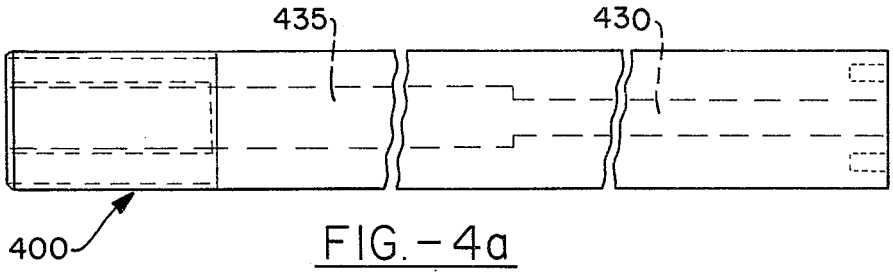
FIG. 4 composed of FIGS. 4A and 4B, are side plan views of the spin roller shaft and the feeding plunger.
Figure 4B:
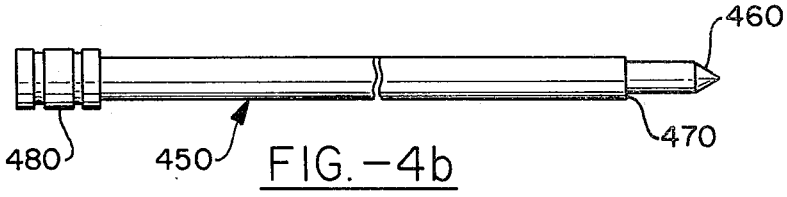

The spin roller shaft 400 is a hollow cylinder, within which feeding plunger 450 having a forward bore 430, a rear bore 435, and a terminus 460 reside, the side plans of which are also seen in FIGS. 4A–4B. The use of feeding plunger 450 having blank tab 470 and knob 480 will be more adequately explained in reference to FIGS. 10A through 10G hereinbelow. The entire pin roller shaft 400 is movably mounted within the internal spin roller assembly 220, such that ball bearing mechanisms 240, as seen in FIG. 1, are provided to permit the axial movement of the spin roller shaft 400 within the internal spin roller assembly 200.

Figure 3:
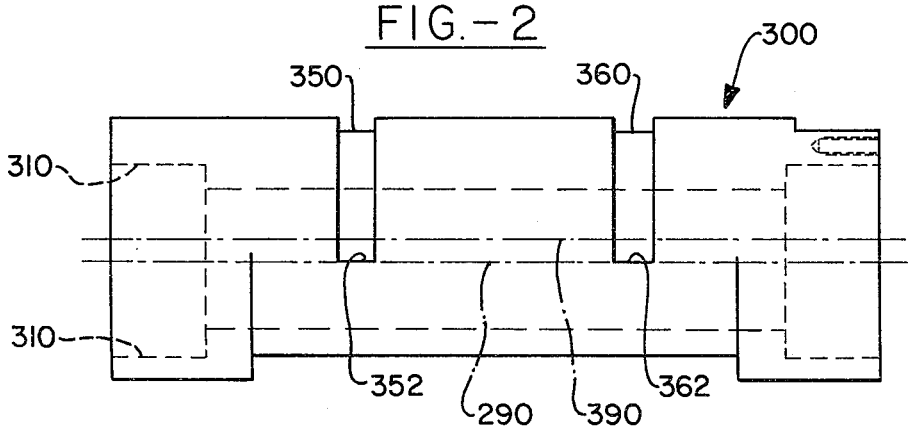
FIG. 3 is a side plan view of the oscillating shaft cylinder means.

Referring to FIG. 3, slidably mounted on the exterior circumference of the spin roller shaft 400 is the oscillating shaft cylinder 300. The outer circumferential recesses 350 and 360 extend approximately 180° around the outer circumference of the oscillating shaft cylinder means. The internal circumference 310 (radially related to a line coincident with the axial line 290 of the spin roller shaft 400) of the cylinder means 300 is offset with respect to the axial line 390 of cylinder 300. Therefore, a shift in the rotation of oscillating shaft cylinder 300 will deflect the axial line 290 of the spin roller shaft 400.

Figure 5:
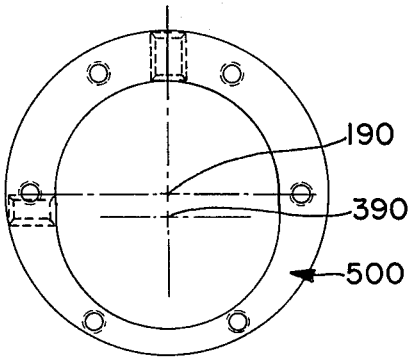
FIG. 5 is an end plan view of the elliptical cylinder means.
Figure 6:
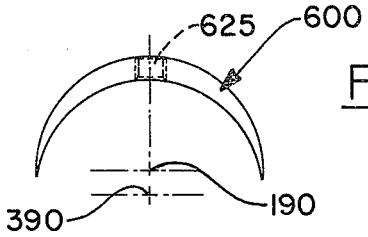
FIG. 6 is an end plan view of the crescent insert.

As will be disclosed in greater detail hereinbelow with reference to FIG. 10, the deflection of oscillating shaft cylinder 300 is accomplished within elliptical cylinder 500 as modified by crescent 600 seen in FIGS. 5 and 6. Items 500 and 600 comprise the outer boundaries of the internal spin roller assembly 200. Examination of FIGS. 5 and 6 indicate the ability of oscillating shaft cylinder 300, guiding spin roller shaft 400 to maintain rotation in an axially deflected position. The presence of the crescent member 600 secured through aperture 625 within the elliptical cylinder 500 alters the shape of the interior diameter from an elliptical framework to a circular framework.

Figure 7:
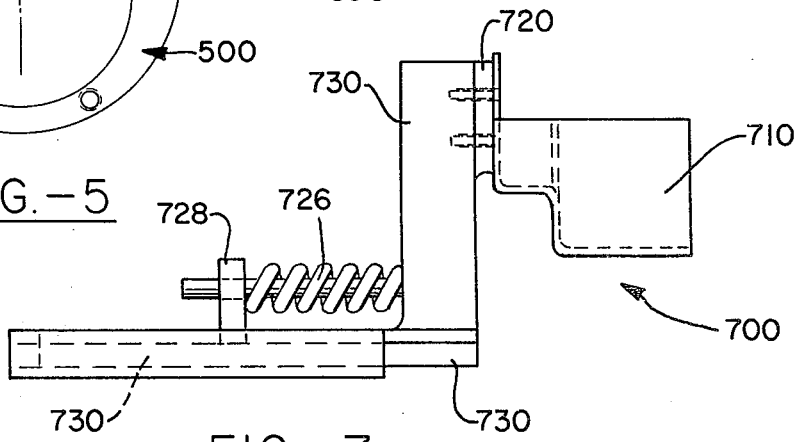
FIG. 7 is a side view of the pulley blank orientation device.
Figure 8:
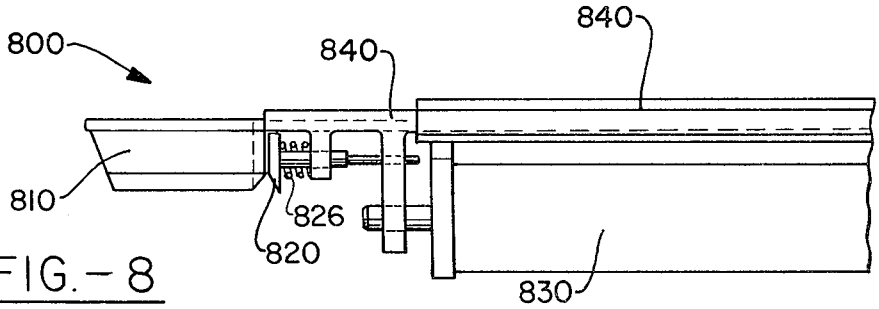
FIG. 8 is a side plan view of the blank loading device.
Figure 9:
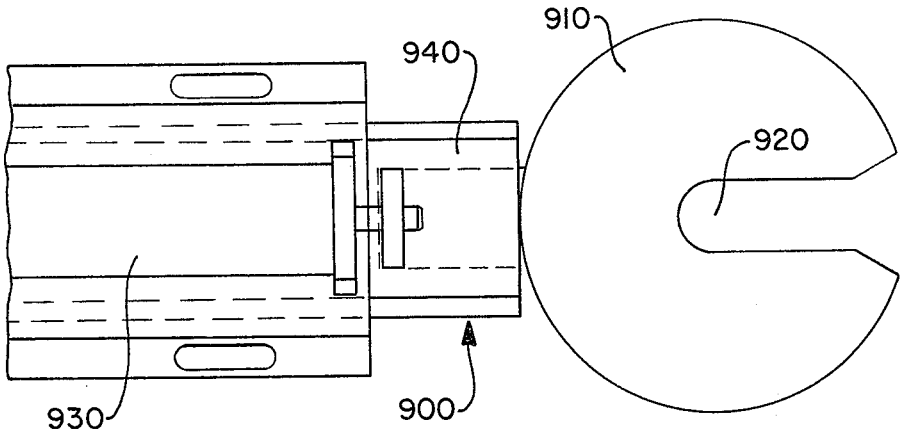
FIG. 9 is a top plan view of the pulley unloading device.

The placement of the pulley blank 50 and the removal of the pulley product 70 is shown by FIGS. 7 through 9. FIG. 7 illustrates the side plan view of the blank orientation device 700. This device is equipped with a seat 710, adjacent to a permanent magnet 720, both of which are mounted on a sliding frame 730 to provide a stable position wherein the pulley blank may be removed and inserted into the main assembly device. The shape of the seat 710 is designed to accommodate a pulley blank 50, and the magnet 720 located adjacent thereto maintains the position of the metallic pulley blank 50 until placement of the blank 50 in the manufacturing frame 10 can be effectuated. The sliding frame is tensionally restrained by a spring 726 and a post 728.

Referring now to FIG. 8, an understanding of the device which places the pulley blank 50 into the manufacturing frame 10 may be seen and understood. This blank loading device 800 is composed of a semi-annular clamp 810, a pressure clamp 820, and a pressure means 830 with spring 826 for not only engaging the pulley blank between the pressure clamp 820 and the semi-annular clamp 810, but also shifting the entire device 800 along a slidable frame 840 from the blank orientation device 700 to the head stock assembly 100.

Following manipulation of the pulley 70 as will be disclosed hereinbelow, the pulley unloading device 900 as seen in FIG. 9 is utilized. Having a framework 940 similar to the slidable frame 840 of blank loading device 800, the pulley unloading device 900 extends into the working area following manipulation of the pulley blank 50, engages the completed pulley 70, and withdraws the same to a storage point. The movement of device 900 is accomplished with a similar pressurized sliding means 930 as that found as pressure means in the blank loading device 800. The pulley product 70 is removed by engagement thereof with a removal disc 910 which may employ electromagnetism to engage the pulley to it. This disc 910 is designed with a slot 920 to accommodate the remaining portions of the internal spin roller assembly 200 which maintain the pulley in its position against the tail stock assembly 1000, namely the feeding plunger 450 extending through the internal diameter of the pulley.

Figure 11:
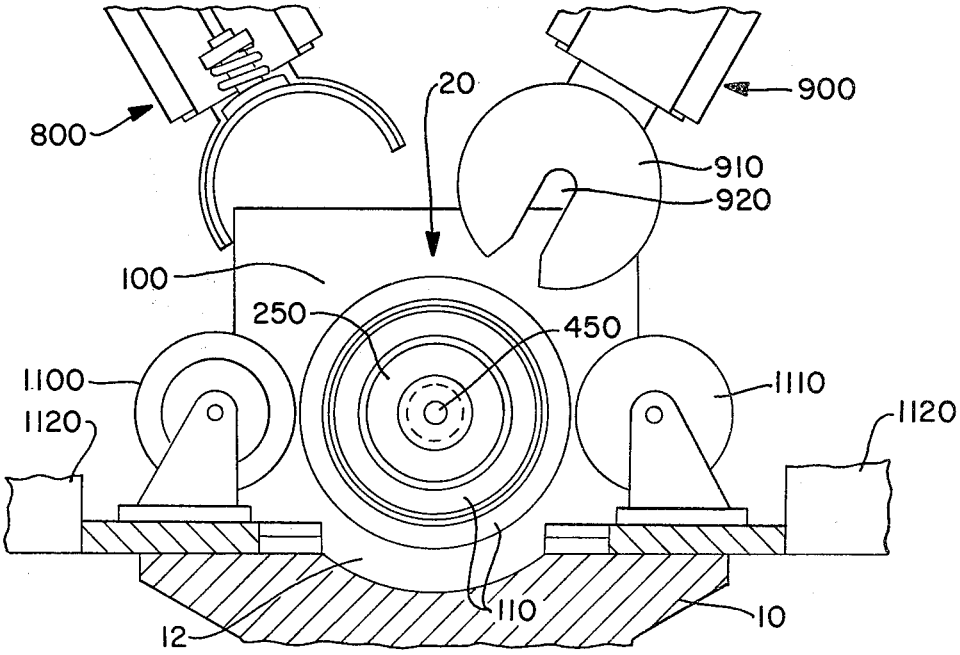
FIG. 11 is an end plan view of the automated pulley manufacturing assembly showing the external roller assembly.

Referring to FIG. 11, the combination of the entire assembly 20 is seen. Frame 10 holds the head stock assembly 100 above a recess 12 by frame brackets (not shown). Above head stock assembly 100 are blank loading device 800 and pulley unloading device 900 which both serve to fully automate the pulley manufacturing process. Flanking head stock assembly 100 are beginning spin roller 1110 and finish external spin rollers 1100 which are slidable along frame 10 to engage pulley blank 50 for pressure of deformation. Sliding means 1120 must be sufficiently rigid to provide continual, pressured contact of the beginning external spin rollers 1110 and finish external spin rollers 1100 to maintain engagement against pulley blank 50. Sliding means 1120 may be controlled by hydraulic, gear, or other mechanisms known to those skilled in the art for transforming pulley blanks 50 into pulleys 70. As the deformation continues, constant pressure of rollers 1110, then rollers 1100, transforms the blank 50 into the desired shape. The external spin rollers 1110 and 1100 spinning on shaft 1106 on brackets 1108 are used for both single or multiple groove pulleys 70. Although the pressure may vary, both operations using sliding means 1120 must maintain sufficient deformation pressure.

The various devices described above proceed in a mechanized fashion to create a pulley 70 from a pulley blank 50. Reference is had to FIG. 10 composed of FIGS. 10A through 10G for an understanding of the nature of the manufacturing process utilizing these various devices 100 through 1000.

The transformation of the pulley blank into the completed pulley product is accomplished by the series of automated steps described in FIGS. 10A through 10G. Specifically, in FIG. 10A, the pulley blank is moved into the blank orientation device 700, the side wall 54 of the blank 50 resting in the seat of the orientation device, and the pulley blank 50 held in place by the permanent magnet 720 residing adjacent to the tail stock portion 56 of the pulley blank 50. The orientation device 700 is the intermediary apparatus between the storage facility for the pulley blank 50 and the insertion of the same into the manufacturing apparatus.

Figure 10A:
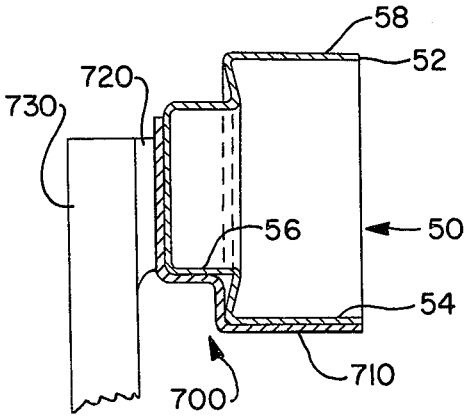
FIG. 10, composed of FIGS. 10A through 10G, is a diagrammatical sequence of the method for manufacturing the pulleys utilizing an internal spin roller assembly.
Figure 10B:
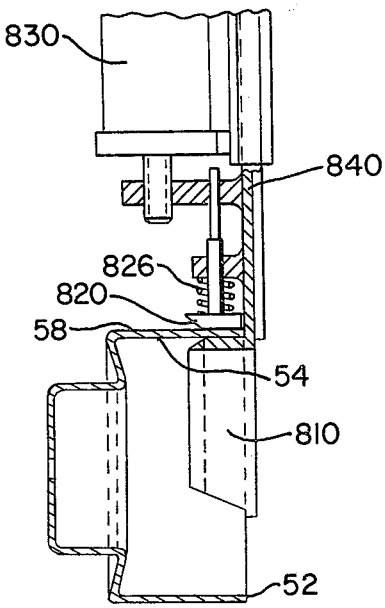

FIG. 10B illustrates the removal of the pulley blank from the blank orientation device 700 by the blank loading device 800. Semi-annular clamp 810 and pressure clamp 820 are separated by applying a pressure between them provided by translating a tensional pressure on spring 826 on orientation device 700 through the open end 52 of pulley blank 50. This tensional securement of blank 50 between clamp 810 and 820 on sidewall 54 and exterior surface 58 permits movement of blank 50 on the orientation device 700 into the manufacturing frame 10. The entire movement of the clamps 810, 820 with the blank 50 is accomplished by the pressure means 830, and the blank 50 travels from its orientation point into the space between the head stock assembly 100 and the tail stock assembly 1000, and external spin rollers 1100 and 1110. The semi-annular clamp 810 has an arc adapted to conform to the interior circumference of the pulley blank. The size and degree of the arc may be adjusted to accommodate the different sizes of pulley blanks 50 employed in the manufacturing process.

Figure 10C:
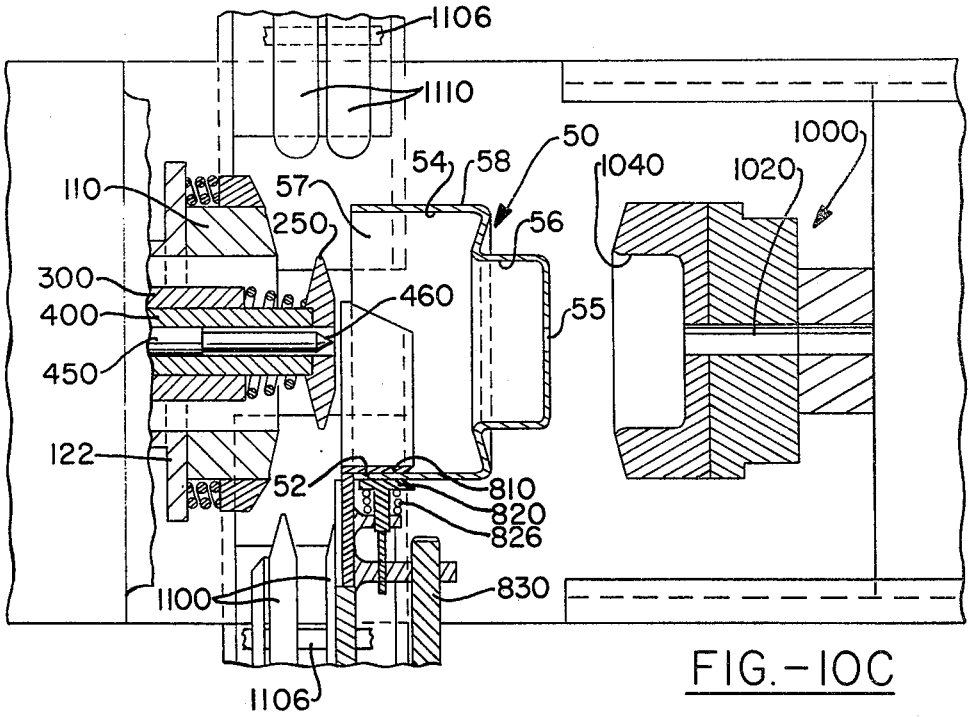
Figure 10D:
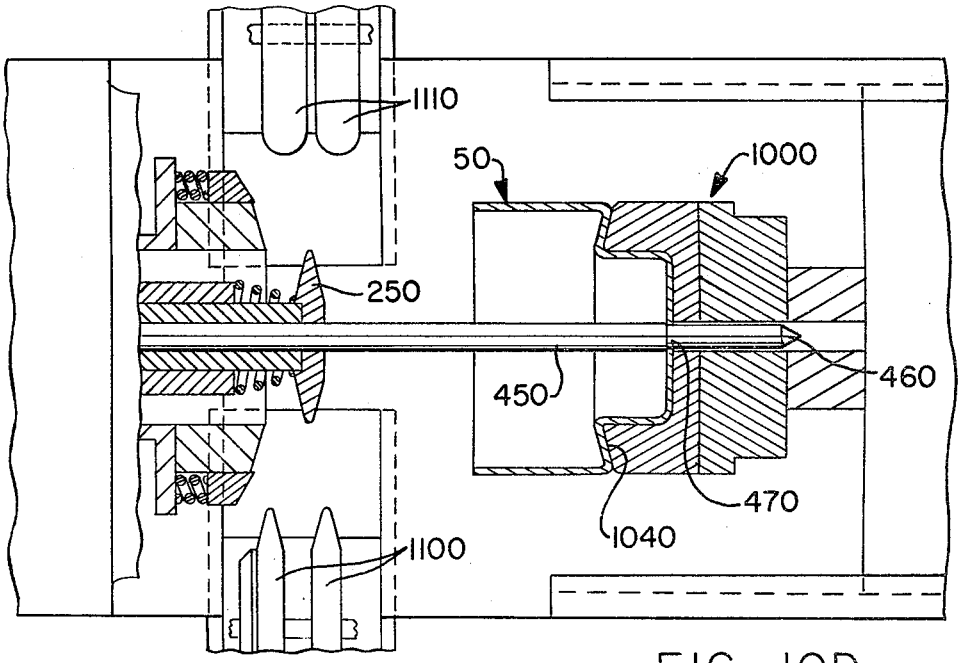

FIGS. 10C and 10D illustrate the positioning of the pulley blank between the head stock assembly 100, the tail stock assembly 1000, and external rollers 1100 and 1110. The semi-annular clamp 810 must be slotted near its axis to permit alignment operations as shown by FIGS. 10C and 10D. That alignment is accomplished by the use of feeding plunger 450 extending from the internal spin roller assembly 200 and the head stock assembly 100 through the interior area 57 of the pulley blank 50 through the internal diameter 55 of the tail stock portion 56 of the pulley blank and into a hollowed cylinder area 1020 along the axis within the tail stock assembly 1000. As the feeding plunger 450 extends through the course described above within forward bore 430 and rear bore 435, the pulley blank 50 engages an expanded diameter portion 470 of the feeding plunger 450 and travels with it to engage the tail stock seat 1040. Concurrent with the movement of the feeding plunger 450 is a relaxation of the tensional pressure means 826 releasing secured contact between the pulley blank 50 and the pressure clamp 820 and semi-annular clamp 810 of the loading device 800. The shape of the tail stock assembly 1000 is designed to accommodate the particular shape of the pulley blank at its tail stock portion. The shape of seat 1040 of the tail stock assembly 1000 may be altered to accommodate the shape of various pulley blanks 50.

Figure 10E:
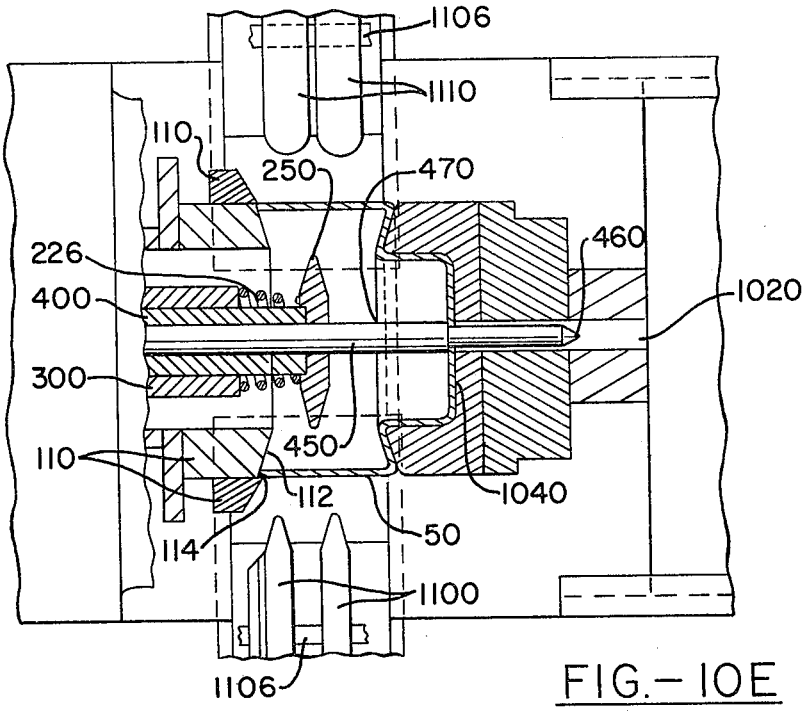

Referring to FIG. 10E, after the pressure means 830 has been released and the entire loading device 800 has been retracted, tail stock assembly 1000 advances by means of gearing (not shown) to engage the pulley blank 50 with head stock assembly 100. This step in the process occurs while the feeding plunger 450 maintains alignment with the pulley blank 50 and the tail stock assembly engages the open end 52 of the pulley blank 50 and has recesses 114 sufficient to accommodate the thickness of that sidewall 54. After sufficient contact has been made between the head stock assembly 100, the pulley blank 50 and the tail stock assembly 1000, the feeding plunger 450 is withdrawn by vacuum means 485 from the tail stock assembly 1000 and the pulley blank 50 and retracted to a point well within the internal spin roller assembly 200.

Figure 10F:
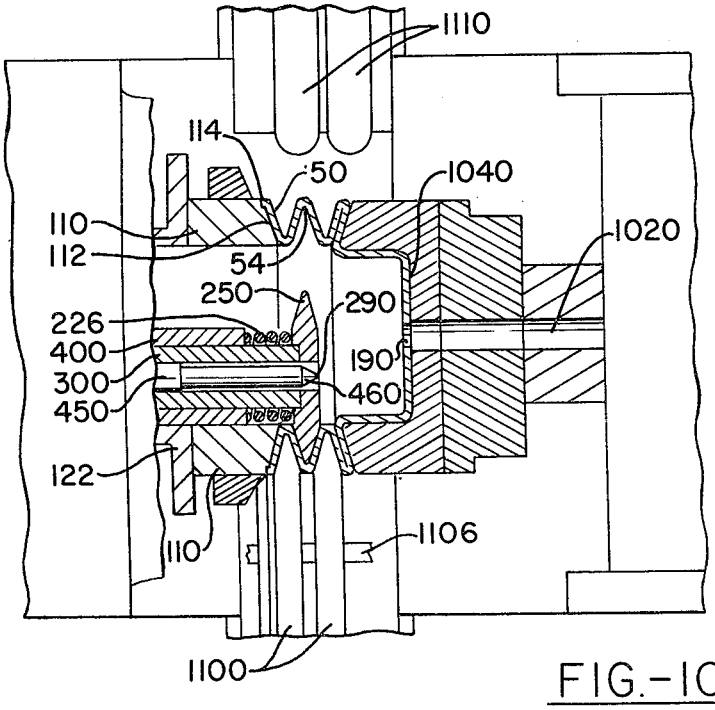

Now referring to FIG. 10F, it is seen that the actual manufacturing of the pulleys occurs by constant pressure between rotating head stock assembly 100 and tail stock assembly 1000, in combination with the deformation applied by engagement of outer circumference 58 of blank 50 by beginning external spin rollers 1110, then finish external spin rollers 1100 and engagement of sidewall 54 of blank by internal spin roller 250 during the rotation which transforms pulley blank 50 to a multiple groove pulley 70. When a multiple groove pulley 70 is desired, the axis 290 of the spin roller assembly 200 is deflected from the axis 190 of the head stock assembly 100 and tail stock assembly 200 by means of the oscillating shaft cylinder 300 placed within the elliptical cylinder 500 as internally shaped by the crescent member 600 secured by fasteners 620. For single groove pulleys, the actual manufacturing of the pulleys occurs by use of constant pressure between rotating head stock assembly 100 and rotating tail stock assembly 1000, in combination with the deformation applied by beginning external spin rollers 1110 and finish external spin rollers 1100 engaging the outer circumference 58 of pulley blank 50. First, the slidable external spin rollers 1110 and then finish external spin rollers 1100 engage the outer circumference 58 of blank 50 during spinning.

Referring again to FIG. 1, the deflection of the axis of the internal spin roller assembly 200 is accomplished by rotation of the oscillating shaft cylinder means 300 by use of gearing 330 attached to a power source (not shown) and the oscillating shaft cylinder means 300. The recesses 350 and 360 in the outer circumferential surface of oscillating shaft cylinder means 300 limit the rotation of shaft 300 within elliptical cylinder 500. Use of the gearing 330 rotates the oscillating shaft 300 to a point where the ends 352 and 362 of the recesses 350 and 360 engage restraining pins 354 and 364 located within the elliptical cylinder 500. This rotation about axis 390 of the oscillating shaft cylinder means 300 alters the axis 290 of the internal spin roller shaft 400 in order to permit at least one spin roller 250 to engage the sidewall 54 of the pulley blank 50. As the axial pressure between the head stock assembly 100 and tail stock assembly 1000 is maintained, the rotation of drive shaft 120 of head stock assembly 100 and the pressure exerted by the slidable external spin rollers 1110 or 1100 and rollers 250 against the pulley blank 50 deforms the pulley blank 50 in accordance with the shape of the number of rollers 1100 or 1110 and internal spin rollers 250.

The number of external spin rollers may be adapted to accommodate the requirements for the particular pulley product 70 by adding more rollers 1100 or 1110 on the shafts 1106 on bearing brackets 1108, as known to those skilled in the art. The number of internal spin rollers may be adapted to accommodate the requirements for the particular pulley product 70 by adjusting nuts 415 against bushing 417 to place additional rollers 250 on the internal roller shaft 400 with additional compression springs 226 added between adjacent rollers 250. As shown in FIG. 10, only one spin roller 250 is provided. However, an examination of FIG. 1 indicates the adaptation of the internal spin roller assembly 200 to accommodate a second spin roller 250.

The rotation of the head stock assembly 100 through drive shaft 120, in combination with the external spin rollers 1110 and 1100 and the axially deflected position of the internal spin roller assembly 200, performs the transformation of the pulley blank 50 into the pulley product 70. The deflection of the internal spin rollers 250 must be maintained during the transformation and the external spin rollers 1110 or 1100 must continually engage pulley blank 50 in a pressured contact. The slidable external spin rollers 1100 continue to deform the blank 50 by this constant pressure applied by sliding means 1120. The external spin rollers 110 or 1100 reach a mating communication with internal spin rollers 250 as the transformation of the pulley blank concludes, as seen in FIG. 10F. Both the head stock assembly 100 and the internal spin roller assembly 200 must have bearings 140 and 240 for moving rotationally and axially to maintain the pressure against open end 52, tail stock portion 56, and side walls 54 and external circumference 58 of the pulley blank 50 to permit a true deformation to be accomplished. In any case, the axial movement of the internal spin roller assembly 200 must not interfere with the securement of the oscillating shaft cylinder means 300 within elliptical cylinder means 500. There is significant resistance upon application of the spin rollers 250 to the pulley blank 50, and the gearing 330 for deflecting the axis 290 of the internal spin roller assembly 200 cannot be encumbered by incomplete axial movement of the same assembly 200.

Referring again to FIG. 10F, following desired deformation, the deflection of the axis 290 of the internal spin roller assembly 200 is eliminated and a reverse rotation of the oscillating shaft cylinder means 300 occurs by means of the same gearing 330 which caused the deflection. This places the axis 290 of the internal spin roller assembly 200 along the same line as the axis 190 for the head stock assembly 100 and the tail stock assembly 1000.

Figure 10G:
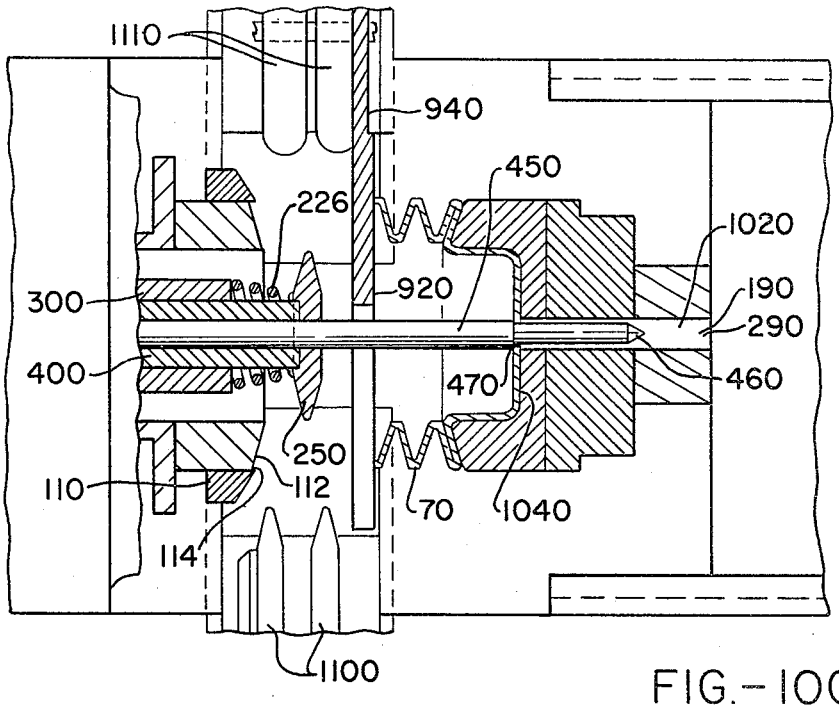

Referring to FIG. 10G, once the axes 190 and 290 coincide, the feeding plunger 450 extends from the internal spin roller assembly 200 for the tab 470 to engage the tail stock portion 56 of the pulley product 70 and the terminus 460 to engage the hollow cylinder area 1020 of the tail stock assembly 1000. The retraction by the tail stock assembly 1000 permits access of the pulley unloading device 900. While the pulley product 70 is maintained in its position through the use of the feeding plunger 450 securing the same to the seat 1040 of tail stock assembly 1000, the pulley unloading device 900 extends between the head stock assembly 100 and the pulley product. The extension of device 900 is a removal disc 910 having a slot 920 extending radially from its axis to facilitate movement of the disc between assemblies 100 and 1000 without engaging the feeding plunger 450. The metallic pulley 70 is electromagnetically held to the removal disc 910 and the feeding plunger 450 may be retracted.

The mechanism 485 for extending and retracting the feeding plunger may be an air cylinder or other hydraulic device which moves the plunger 450 and then maintains its position according to a pressure within that device 485, as seen in FIG. 1. The retraction of the feeding plunger is accomplished by building a vacuum within mechanism 485. Control of plunger 450 by pressure/vacuum means 485 may increase the efficiency of the production of pulleys 70 over spring tension devices commonly used in the art for various purposes. As the feeding plunger 450 is retracted from the tail stock assembly 1000 and into the internal spin roller assembly 200, the pulley product is secured to the electromagnetic removal disc 910 on pulley unloading device 900 and the seat 1040 on the tail stock assembly 1000. Further, retraction of the tail stock assembly 1000 releases this securement and the pulley product 70 is removed to a storage point by retraction of the removal disc 910. As seen with reference to blank loading device 800 and feeding plunger 450, the extension and retraction of the removal disc 910 is accomplished by an air cylinder or other hydraulic device 930 located on the frame 940 of pulley unloading device 900.

When the single groove pulley 70 is desired, the deflection of oscillating shaft cylinder means 300 within elliptical cylinder 500 is not employed. Rather, all operation steps of securement of pulley blank 50 between head stock assembly 100 and tail stock assembly 1000 using feeder plunger 450 remain the same. Deformation of blank 50 into pulley 70 occurs by slidable pressure of external spin rollers 1110 and 1100, the former starting the deformation and the latter completing it. The pressured contact of external spin rollers 1110 or 1100 against blank 50 is maintained as the drive shaft 120 rotates head stock assembly 100 and tail stock assembly 1000. After transformation is complete, the tail stock assembly 1000 is withdrawn and pulley removal assembly 900 is employed as described above.

Figure 2:
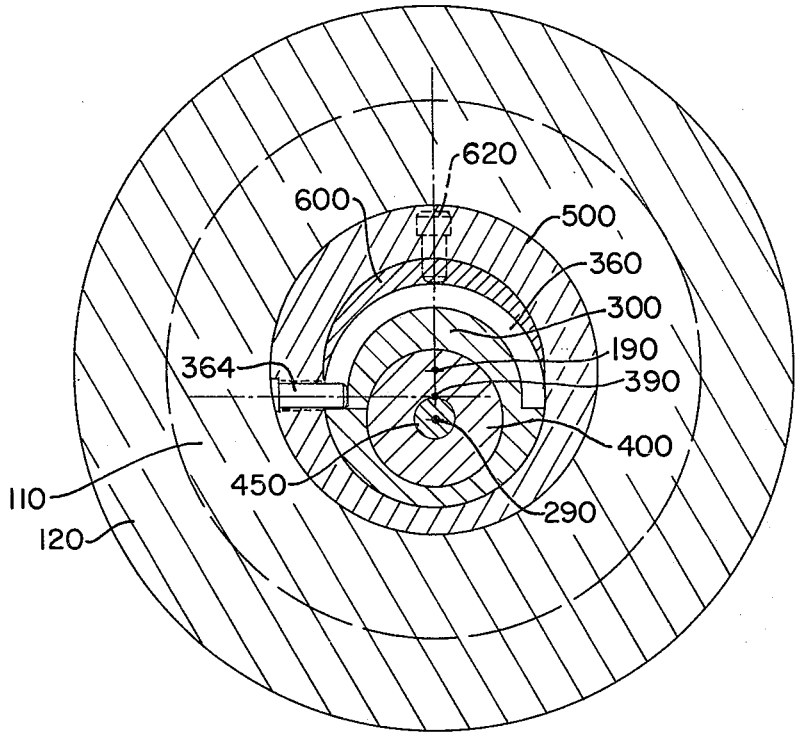
FIG. 2 is a diagrammatic cross sectional view of the axial relationships among the various shafts within the head stock assembly and the internal spin roller assembly.

FIG. 2 describes the axial relationships so important to the manufacturing apparatus and process. The circles and ellipses of this cross sectional view demonstrate the deflection of axis 190 from axis 290 about the rotation of cylinder 300 on axis 390. This deflection along recesses 350 and 360 of oscillating shaft cylinder 300 to restraining pins 354 and 364 is a controlled rotation of a circular object within an elliptical object because the crescent member 600 is secured within elliptical cylinder 500 by fastener 620 and compensates for the geometrical differences of circumference.

Upon removal of the pulley product 70 from the position between the head stock assembly 100 and the tail stock assembly 1000, the process of manufacture described throughout FIGS. 10A and 10G may be repeated. The automation of such a manufacturing process could produce as many as 600 pulley products per hour utilizing the internal spin roller assembly 200 in in conjunction with devices 700, 800 and 900, especially as a result of feeding plunger 450 being controlled by pressure/vacuum means 485. The production of 600 pulleys within an hour utilizing this machine constitutes an advancement over the art and a satisfaction of the objects of the invention listed above. Further, the use of devices 700, 800, 900 and the internal spin roller assembly 200 permits the head stock assembly 100 to maintain constant rotation during the automated repetition of manufacture. The constant rotation of head stock assembly 100 not only eliminates the time to start and stop the assembly 100, according to the manufacturing devices known in the art, but also maintains the quality of the pulley product so manufactured through its maintenance of a true rotation. While the former improves the quantity of pulley products produced, the latter also improved the quality of pulley products produced.

While in accordance with the requirements for patent-ability, a detailed description of the best mode and preferred embodiment of the invention has been presented hereinabove, nevertheless the invention is not to be limited thereto or thereby. Consequently, for a full appreciation of the scope of the invention, reference is had to the following claims.

What is claimed is:

1. A method for the manufacture of multiple groove pulleys comprising:

(a) inserting a pulley blank into a blank orientation device;

(b) removing the pulley blank from said blank orientation device using a blank loading device;

(c) positioning the pulley blank, on said blank loading device, in orientation between a tail stock assembly and a head stock assembly of an internal spin pulley manufacturing device;

(d) extending a feeder plunger in a spin roller shaft from said head assembly;

(e) securing the pulley blank between said head stock assembly and said tail stock assembly;

(f) retracting said feeder plunger to within said spin roller shaft;

(g) removing said blank loading device;

(h) spinning said head stock assembly about a rotatable hollow drive shaft, said spinning revolving the pulley blank and said tail stock assembly;

(i) engaging at least one internal spin roller with the internal circumference of the pulley blank;

(k) sliding at least two external spin rollers and engaging said external spin rollers with the exterior circumference of the pulley blank;

(l) maintaining said internal spin roller engagement and maintaining said external spin roller engagement during said spinning of said head stock assembly and said securement of the pulley blank between said head stock assembly and said tail stock assembly until a pulley is produced by deformation from the pulley blank;

(m) aligning the axis of said spin roller shaft with the axis of said hollow drive shaft, thereby disengaging said internal spin rollers from the internal circumference of the pulley;

(n) sliding said external spin rollers from engagement with the exterior circumference of the pulley;

(o) extending said feeder plunger from said spin roller shaft to engage the pulley at its axis;

(p) inserting an electromagnetic removal disc on a pulley unloading device between said tail stock assembly and said head stock assembly;

(q) retracting said feeder plunger to within said spin roller shaft from the internal axis of the pulley; and (r) removing said pulley by said electromagnetic removal disc.

2. A method for the manufacture of multiple groove pulleys, according to claim 1, wherein said spinning of said head stock assembly about said rotatable hollow drive shaft remains at a constant revolutions per minute without interruption for the insertion of the pulley blank and the removal of the pulley product.

3. A method for the manufacture of multiple groove pulleys, according to claim 1, wherein said tail stock assembly slides toward said head stock assembly after said extending of said feeder plunger from said spin roller shaft from said head stock assembly thereby firmly securing the pulley blank between said head stock assembly and said tail stock assembly.

4. A method for the manufacture of multiple groove pulleys, according to claim 1, wherein said tail stock assembly slides from said head stock assembly prior to said inserting of said electromagnetic removal disc on said pulley unloading device, thereby permitting access of said unloading device to the pulley product.

5. A method for the manufacture of single groove pulleys comprising:

(a) inserting a pulley blank into a blank orientation device;

(b) removing the pulley blank from said blank orientation device using a blank loading device;

(c) positioning the pulley blank, on said blank loading device, in orientation between a tail stock assembly and a head stock assembly of an external spin pulley manufacturing device;

(d) extending a feeder plunger in a spin roller shaft from said head stock assembly to engage the pulley blank at its axis;

(e) securing the pulley blank between said head stock assembly and said taii stock assembly;

(f) retracting said feeder plunger to within said spin roller shaft;

(g) removing said blank loading device;

(h) spinning said head stock assembly about a rotatable hollow drive shaft, said spinning revolving the pulley blank and said tail stock assembly;

(i) sliding at least two external spin rollers and engaging said external spin rollers with the exterior circumference of the pulley blank;

(j) maintaining said external spin roller engagement during said spinning of said head stock assembly and said securement of the pulley blank between said head stock assembly and said tail stock assembly until a pulley is produced by deformation from the pulley blank;

(k) sliding said external spin rollers from engagement with the exterior circumference of the pulley;

(l) inserting an electromagnetic removal disc on a pulley unloading device between said tail stock assembly and said head stock assembly;

(m) retracting said feeder plunger to within said spin roller shaft from the external axis of the pulley; and (n) removing said pulley by said electromagnetic removal disc.

6. A pulley manufacturing device for the transformation of pulley blanks into pulley products having at least one groove, comprising:

(a) a manufacturing frame;

(b) a spin pulley manufacturing device having a tail stock assembly, a head stock assembly, an internal spin roller assembly, and an external spin roller assembly;

(c) a blank orientation device;

(d) a blank loading device, and (e) a pulley unloading device wherein said head stock assembly has a spinning ring and a rotatable, hollow drive shaft;

said spinning ring having means for securement of the pulley blank to said spinning ring during manufacturing;

said head stock assembly further having means for rotating said shaft and said spinning ring, and further wherein said internal spin roller assembly has at least one internal spin roller and a spin roller shaft, each said internal spin roller mounted on said spin roller shaft;

said spin roller shaft axially movable within said hollow drive shaft of said head stock assembly.

7. A pulley manufacturing device for the transformation of pulley blanks into pulley products having at least one groove, according to claim 6, wherein said spin roller has tension means for mounting each said internal spin roller on said spin roller shaft.

8. A pulley manufacturing device for the transformation of pulley blanks into pulley products having at least one groove, according to claim 6, wherein said spin roller shaft has an oscillating-elliptical cylindrical means, between said hollow drive shaft and said spin roller shaft, for deflecting the axis of said spin roller shaft from the axis of said hollow drive shaft, thereby deflecting said internal spin rollers mounted on said spin roller shafts.

9. A pulley manufacturing device for the transformation of pulley blanks into pulley products having at least one groove, according to claim 8, wherein said oscillating-elliptical cylinder means is deflected along means for tracking and maintaining the deflection of the axis of said spin roller shaft from the axis of said hollow drive shaft.

10. A pulley manufacturing device for the transformation of pulley blanks into pulley products having at least one groove, according to claim 9, wherein said oscillating-elliptical cylinder means comprises an elliptical cylinder modified therewithin by a crescent member, said crescent-modified elliptical cylinder controlling the rotation of said spin roller shaft relative to said hollow drive shaft.

11. A pulley manufacturing drive for the transformation of pulley blanks into pulley products having at least one groove, according to claim 10, wherein said elliptical cylinder means has a plurality of rolling means for permitting the rotation of said hollow drive shaft relative to the stationary position of said spin roller shaft.

12. A pulley manufacturing device for the transformation of pulley blanks into pulley products having at least one groove, according to claim 11, wherein said elliptical cylinder means has power means for deflecting the axis of said spin roller shaft from the axis of said hollow drive shaft.

13. A pulley manufacturing device for the transformation of pulley blanks into pulley products having at least one groove, according to claim 12, wherein a plate with at least one fastener secures said oscillating elliptical cylinder means to said frame.

14. A pulley manufacturing device for the transformation of pulley blanks into pulley products having at least one groove, according to claim 6, wherein said spin roller shaft has a forward bore, a rear bore, and a feeding plunger residing within said forward bore and said rear bore.

15. A pulley manufacturing device for the transformation of pulley blanks into pulley products having at least one groove, according to claim 14, wherein said feeding plunger has vacuum and pressure means for sliding said feeding plunger from said forward bore and said rear bore of said spin roller shaft.

16. A pulley manufacturing device for the transformation of pulley blanks into pulley products having at least one groove, according to claim 15, wherein said hollow drive shaft has bearing means for rotation of said head stock assembly relative to said frame.

17. A pulley manufacturing device for the transformation of pulley blanks into pulley products having at least one groove, according to claim 15, wherein said feeding plunger has a conical terminus and an expanded diameter portion to engage the pulley blank and push it into contact with said tail stock assembly.

18. A pulley manufacturing device for the transformation of pulley blanks into pulley products having at least one groove, according to claim 6, wherein said blank orientation device comprises seating means for supporting the blank during orientation, magnetic means for maintaining the blank in said feeding means, and a frame housing said seating means and said magnetic means, said frame having a tensional sliding means for adjusting said seating means during orientation.

19. A pulley manufacturing device for the transformation of pulley blanks into pulley products having at least one groove, according to claim 6, wherein said blank loading device comprises a semi-annular clamp shaped to engage the interior circumference of the pulley blank, a pressure clamp shaped to engage the exterior circumference of the pulley blank, pressure means for maintaining the engagement of said pressure clamp with the exterior circumference of the pulley blank, and also for maintaining the engagement of said semi-annular clamp with the interior circumference of the pulley blank, and a frame supporting said semi-annular clamp, said pressure clamp, and said pressure means, said frame having pressurized sliding means for shifting the blank into said internal spin pulley manufacturing device.

20. A pulley manufacturing device for the transformation of pulley blanks into pulley products having at least one groove, according to claim 6, wherein said pulley unloading device comprises an electromagnetic removal disc having a slot adapted to avoid a shaft transverse to said disc, and a frame supporting said disc having pressurized sliding means for removing the pulley product from said internal spin pulley manufacturing device.

21. A pulley manufacturing device in the transformation of pulley blanks into pulley products having at least one groove, comprising:

(a) a manufacturing frame;

(b) a spin pulley manufacturing device having a tail stock assembly, head stock assembly, an internal spin roller assembly, and an external spin roller assembly;

wherein said head stock assembly has a spinning ring and a rotatable, hollow drive shaft; said spinning ring having means for securement of the pulley blank to said spinning ring during manufacturing; said head stock assembly further having means for rotating said shaft and said spinning ring and further wherein said internal spin roller assembly has at least one internal spin roller and a spin roller shaft, each said internal spin roller mounted on said spin roller shaft; and wherein said spin roller shaft has an oscillating-elliptical cylindrical means between said hollow drive shaft and said spin roller shaft, for deflecting the axis of said spin roller shaft from the axis of said hollow drive shaft, thereby deflecting said internal spin rollers mounted on said spin roller shafts.

22. A pulley manufacturing device for the transformation of pulley blanks into pulley products having at least one groove, according to claim 21, wherein said oscillating-elliptical cylinder means is deflected along means for tracking and maintaining the deflection of the axis of said spin roller shaft from the axis of said hollow drive shaft.

23. A pulley manufacturing device for the transformation of pulley blanks into pulley products having at least one groove, according to claim 22, wherein said oscillating-elliptical cylinder means comprises an elliptical cylinder modified therewithin by a crescent member, said cresent-modified elliptical cylinder controlling the rotation of said spin roller shaft relative to said hollow drive shaft.

24. A pulley manufacturing device for the transformation of pulley blanks into pulley products having at least one groove, according to claim 23, wherein said elliptical cylinder means has a plurality of rolling means for permitting the rotation of said hollow drive shaft relative to the stationary position of said spin roller shaft.

25. A pulley manufacturing device for the transformation of pulley blanks into pulley products having at least one groove, according to claim 24, wherein said elliptical cylinder means has power means for deflecting the axis of said spin roller shaft from the axis of said hollow drive shaft.

26. A pulley manufacturing device for the transformation of pulley blanks into pulley products having at least one groove, according to claim 25, wherein a plate with at least one fastener secures said oscillating elliptical cylinder means to said frame.

* * * * *